United States Patent [19]

Mullins

[11] 4,186,540

[45] * Feb. 5, 1980

[54] INTERLOCKING CEMENTITIOUS BUILDING BLOCKS

[76] Inventor: Wayne L. Mullins, 5001 E. Cactus, Scottsdale, Ariz. 85254

[ * ] Notice: The portion of the term of this patent subsequent to Aug. 22, 1995, has been disclaimed.

[21] Appl. No.: 903,731

[22] Filed: May 8, 1978

Related U.S. Application Data

[63] Continuation-in-part of Ser. No. 799,725, May 23, 1977, Pat. No. 4,107,894, which is a continuation-in-part of Ser. No. 736,724, Oct. 29, 1976, abandoned, which is a continuation-in-part of Ser. No. 582,378, Apr. 30, 1975, abandoned.

[51] Int. Cl.[2] ..... E04C 1/10

[52] U.S. Cl. ..... 52/593; 52/606

[58] Field of Search ..... 52/585, 593, 594, 603, 52/604, 606

[56] References Cited

U.S. PATENT DOCUMENTS 4,107,894 8/1978 Mullins ..... 52/596

*Primary Examiner*—Carl D. Friedman

*Attorney, Agent, or Firm*—Herbert E. Haynes, Jr.

[57] ABSTRACT

Cementitious building blocks having upstanding male projections on one planar surface so as to be disposed in a particular geometric array which locates the projections in the corners of passages extending through the blocks. The projections are supported on corner corbels which carry corner spanning shelves which extend inwardly into the passages so as to locate the projections in alignment with the open corners at the opposite ends of the passages. The open corners and aligned male projections allow self-aligning stacked interlocking mortarless assembly of a plurality of such blocks for the construction of buildings, walls and the like.

23 Claims, 10 Drawing Figures

Fig. 8
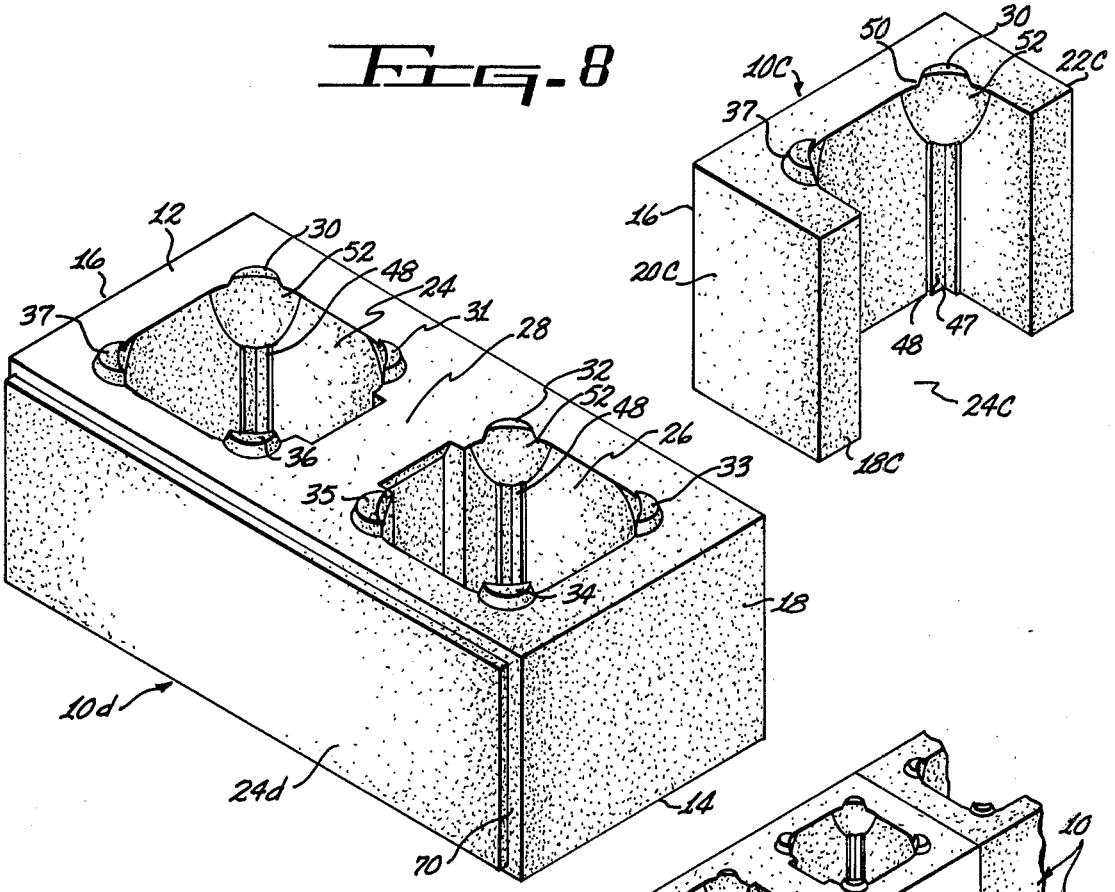
Fig. 9
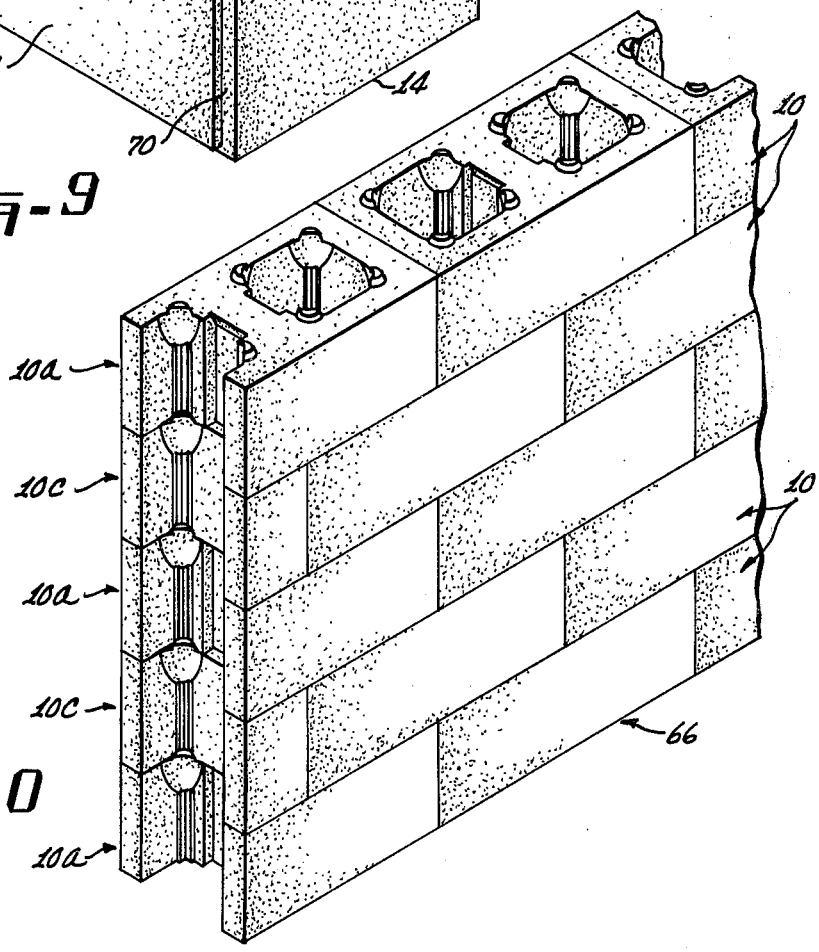
Fig. 10

INTERLOCKING CEMENTITIOUS BUILDING BLOCKS

CROSS-REFERENCE TO RELATED APPLICATIONS

This application is a continuation-in-part of a copending U.S. patent application Ser. No. 799,725, filed May 23, 1977 for: INTERLOCKING CEMENTITIOUS BUILDING BLOCKS, now U.S. Pat. No. 4,107,894, with that application being a continuation-in-part of a copending U.S. patent application Ser. No. 736,724, filed Oct. 29, 1976, for INTERLOCKING BUILDING BLOCK, now abandoned, and that application in turn being a continuation-in-part of a copending U.S. patent application Ser. No. 582,378, filed Apr. 30, 1975, for: INTERLOCKING BUILDING BLOCK, now abandoned, all by the same inventor.

BACKGROUND OF THE INVENTION

1. Field of the Invention

This invention relates to cementitious building blocks and more particularly to self-aligning mortarless interlocking cementitious building blocks.

2. Description of the Prior Art

The use of building blocks, of the type sometimes referred to as cement blocks, concrete blocks, or cinder blocks, rather than conventional clay bricks is becoming more widespread. Such blocks are commonly used by the construction industry for erecting walls, buildings, and the like, and for purposes of this description all such blocks will hereinafter be referred to as cementitious blocks.

The commonly used cementitious blocks are erected in tiers or rows, which are most often offset, and the individual cementitious blocks are bonded together by mortar which is interposed between the meeting horizontal and vertical surfaces of the blocks. The necessity of mortar bonding impairs the accuracy and speed with which such blocks can be erected, and requires a relatively high degree of skill to erect a properly aligned plurality of such blocks.

The degree of skill needed to erect these mortar bonded prior art blocks, not to mention the laborious task, has all but relegated the laying of such blocks to skilled craftsmen.

The laborious task of erecting the mortar bonded blocks and the high cost of employing skilled craftsmen has prompted the search for interlocking cementitious blocks which would ease the labor and degree of skill needed to lay and properly align a plurality of such blocks.

Therefore, there are examples in the prior art of cementitious blocks having recesses in one of the horizontal surfaces and projections extending from the opposite horizontal surface. Such interlocking blocks allow the interlocked assembly of one row of such blocks with parallel coextending rows immediately above and below that row. Many of such prior art interlocking blocks are still bonded together by mortar, and it is believed that the use of such mortar impairs, to at least some degree, the interlocking and ease of accurately aligning such blocks. Although the degree of skill required to lay such interlocking blocks has been reduced, it is still desirable to employ a skilled craftsman as the use of mortar is still required, and the accuracy of block alignment still must be considered.

Still further, other prior art interlocking blocks are known which are mortarless, and all of those blocks have shortcomings of one sort or another. For example, some of those blocks are very heavy which, of course, creates problems for the block layer. Others are loose fitting so that the problems of alignment are not alleviated. One particular interlocking block relies on an interference fit between interlocking elements of the blocks to compensate for dimensional inaccuracies, and this creates assembly problems in that manually applied forces must be exerted to achieve an interference fit which sometimes involves scraping off excess materials. In many instances, building codes require that all cells or cavities within a wall of such prior art blocks be grouted solid with a cementitious material.

While the known art includes an example of a building block having eight recesses entering into the body thereof on one horizontal surface and eight projections extending from the opposite horizontal surface, those recesses and projections are so arranged that it is impossible to interlock one block with another similar block in a normal relationship. This is due to the fact that this known block does not have a relationship between its longitudinal and transverse dimensions which is critical and also because four recesses and four projections at each end of the block define an oblong rather than a square. Thus, it is impossible to interlock the four projections at one end of one block with the four recesses of another block arranged normally thereto.

Another problem with interlocking blocks of the type having eight recesses formed in one planar surface and eight projections extending from the opposite surface, is that of cement fragments, or chips and the like being deposited in the recesses during casting of the blocks and at other times such as during transport, handling, and the like. Such deposits are a constant nuisance in that each recess must be checked just prior to laying of the blocks to insure that the recesses are clean so as not to interfere with the entry of the male projections into the female recesses, as such interference can result in improper interlocking and misalignment of the blocks. When cement fragments are deposited into the recesses at the time of casting of the blocks, the fragments oftentimes adhere to the cement of the blocks and must be chipped out.

It is a long standing custom to form most, if not all, cementitious building blocks with passages formed therein which extend between the horizontal faces. These passages are provided for several reasons. First, they accommodate any wiring, pipelines, and the like which are to be included in a building wall; and secondly, they materially lighten the weight of the blocks to facilitate shipping and handling by the craftsman and reduce the material, and thus, the cost of making the blocks. And, finally, the passages not used to accommodate wiring and pipelines, may be filled with suitable grouting material when it is desired to strengthen an erected structure. The cementitious blocks of this type normally have two passages formed therethrough which are of maximum cross section for weight consideration and to accommodate the wiring and/or pipelines, and must not be excessively large so as to lessen the load bearing capabilities of the block.

Many of the prior art interlocking blocks, as discussed above, have substantially reduced the cross sectional area of the vertical passages formed therein due to the necessity of supporting the interlocking elements of the blocks. This, of course, increases the weight of such blocks, and reduces clearance for wiring and pipelines.

Therefore, a need exists for a new and improved self-aligning mortarless interlocking cementitious buildin block which overcomes some of the problems and shortcomings of the prior art.

SUMMARY OF THE INVENTION

In accordance with the present invention, new and improved cementitious building blocks are disclosed for mortarless interlocked assembly with similar blocks for erecting walls, buildings, and other similar structures. The most commonly employed form of cementitious block is configured to form a dimensionally precise rectangular solid having, among other things, an upper planar surface and a parallel equally sized lower planar surface, both of which are normally disposed in a horizontal attitude when employed for construction, and both of which are normally twice as long as they are wide.

Two vertical passages are formed through the cementitious block and are disposed to extend between the upper and lower surfaces. The passages are designed to provide maximum horizontal cross sectional areas to admit wiring, pipes, and the like, and for weight considerations without impairing the load bearing capabilities of blocks. The passages are configured in substantially square in cross section configuration with such a configuration opening onto the lower, or bottom planar horizontal surface of the block. The upper, or top horizontal planar surface of the block, is formed with a corner spanning shelf at each corner of the passages with the shelves being of substantially triangular configuration and supported by integral corner corbels. Each of the shelves have a male projection extending normally therefrom and each of the projections are, in the preferred embodiment, configured as being approximately one-half of a frustro-conical projection with a vertically disposed substantially planar surface which faces inwardly toward the center of its respective one of the passages.

The location of the shelves and the particular disposition of the projections adjacent the upper surface of the block places those projections in vertical alignment with the open corners of the passages that open onto the lower surface of the block. This configuration allows the blocks to snugly interlock in a self-aligning relationship with other similar blocks disposed above and below, and also allows the blocks to be interlockingly assembled in laterally offset relationships and in cross or normal relationships.

In addition to the above described most commonly employed cementitious building block which may be described as a "full" block, "one-half", "three-quarter", and "one-quarter" blocks are provided for use in framing wall openings, terminating walls, constructing columns and the like. The three-quarter and one-quarter blocks are open on one end thereof, i.e., the passages described above in regard to the full block, are closed on three vertical sides and open on the other. Such openings may, if desired, be exposed on the terminal end of the wall or in a block column to expose an aesthetic appearance which is provided by the internal configuration of the passages.

Accordingly, it is an object of the present invention to provide a new and improved cementitious building block.

Another object of the present invention is to provide new and improved dimensionally precise cementitious building blocks for self-aligning mortarless interlocked assembly.

Another object of the present invention is to provide new and improved cementitious building blocks which are especially configured to have a plurality of male projections extending from one planar surface and enlarged square openings formed in the opposite planar surfaces with those projections being in vertical alignment with the corners of the square openings to allow mortarless self-aligning snug interlocked assembly of the blocks in stacked vertical alignment with each other, in stacked laterally offset alignment, or in stacked normal relationship with each other, for the erection of stacked coextending rows and/or stacked transverse or normal rows.

Another object of the present invention is to provide new and improved self-aligning interlocking mortarless cementitious blocks of the above described character in which the interlocking elements in the form of projections and the enlarged square openings are of special design so as to hold the weight added thereby to a minimum, and to provide a snug fit between the interlocked blocks.

Another object of the present invention is to provide new and improved cementitous building blocks of the above described character each of which are provided with a pair of vertical passages extending therethrough which are especially configured to provide the blocks with minimum weight, maximum clearance for wiring and pipelines, and yet provide sufficient load bearing strength for the blocks.

Another object of the present invention is to provide new and improved self-aligning mortarless interlocking cementitous building blocks of the above described character in which the vertical passages of each block have a substantially square horizontal cross sectional configuration and are provided with corbel supported corner shelves at each corner of the passage adjacent one of the planar surfaces for supporting the male projections of the block in vertical alignment with the open corners of the passages of the block.

Still another object of the present invention is to provide mortarless interlocking cementitious building blocks of the above described character which may be formed in full, one-half, three-quarter and one-quarter blocks.

Yet another object of the present invention is to provide self-aligning mortarless interlocking cementitious building blocks with the three-quarter and the one-quarter blocks displaying an aesthetically appealing open end.

The foregoing and other objects of the present invention as well as the invention itself, may be more fully understood from the following description when read in conjunction with the accompanying drawings.

BRIEF DESCRIPTION OF THE DRAWINGS

FIG. 8 is an isometric view of the one-quarter mortarless interlocking cementitious building block of the present invention.

FIG. 9 is an isometric view similar to FIG. 1 but illustrating a modified embodiment of the building block of the present invention.

FIG. 10 is a fragmentary isometric view illustrating the aesthetically appealing terminal end of a wall formed by the interlocking mortarless cementitious building blocks of the present invention.

DESCRIPTION OF THE PREFERRED EMBODIMENT

Figure 1:
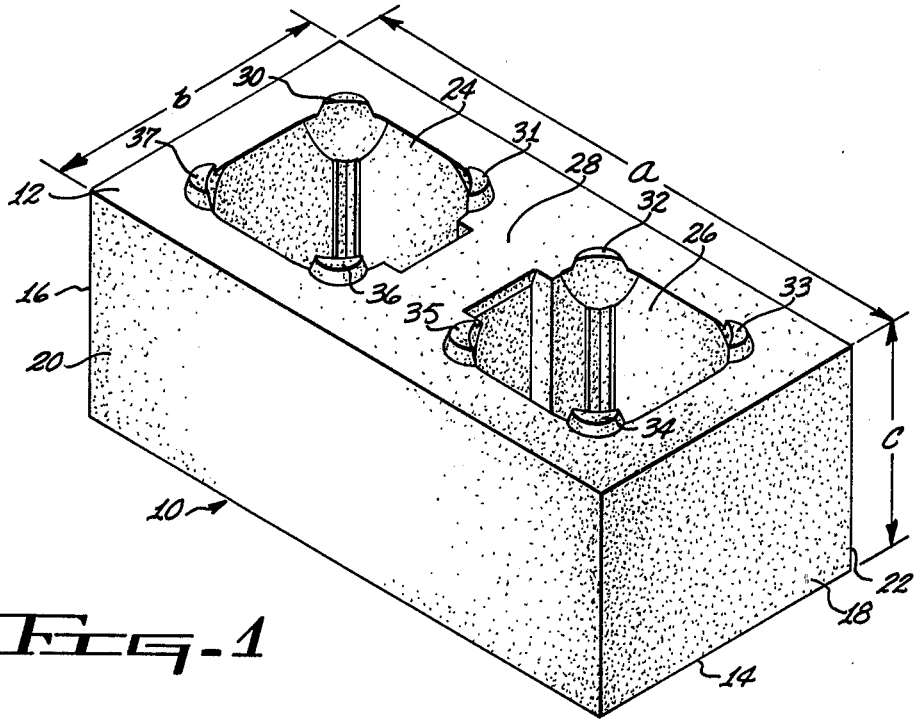
FIG. 1 is an isometric view of the cementitious interlocking mortarless building block of the present invention illustrating the various features thereof.

Referring more particularly to the drawings, FIG. 1 illustrates the most commonly employed mortarless interlocking cementitious building block of the present invention which is indicated generally by the reference numeral 10. At this point, it is well to note that the block 10 is fabricated of cementitious material preferrably formulated in a manner to provide relatively smooth surfaces so that a plurality of such blocks 10 may be interlockingly assembled with the mating surfaces in exact aligned engagement without mortar being interposed therebetween.

The block 10 is formed to provide a rectangular solid configuration having proportions which are conventional in the industry. That is, the longitudinal dimension "a" being twice the width dimension "b". The relationship being dimension "a" and "b" is critical, however, the height dimension "c" may vary. For example, a particular cementitious block having a longitudinal dimension of 16 inches with a width dimension of eight inches, may have a height dimension of four, six or eight inches.

As will become apparent as this description progresses, the blocks of the present invention must be formed with dimensional precision in order to achieve the snug interlocking fits between a plurality of the blocks and thereby produce properly level and aligned walls. To illustrate this point, consider that in prior art mortar bonded blocks, the mortar itself is employed to compensate for dimensional irregularities and inaccuracies which can, and often do, occur in the peripheral dimensions, surface parallelism and the like.

Therefore, the cementitious blocks of the present invention are fabricated with precision peripheral dimensions, in addition to the interlocking elements thereof so that the blocks will snugly interlock to form properly level and aligned walls.

For example, one of the blocks 10 described above as having the desired dimensions of: height, six inches, length, 16 inches and width 8 inches, is fabricated with its height dimension being six inches plus or minus 0.015, its length dimension being in the range of from 15.910 to 15.994 inches and its width dimension being eight inches plus or minus 0.031. As seen, the width dimension is not as critical as the height and length dimensions in that the width dimension controls surface regularity and wall thickness can be allowed to vary somewhat, whereas the length and height dimension controls surface parallelism and the interlocking fit, both of which must be held within specific tolerances. The height and width dimensions are also critical in that an adhesive gap must be provided between meeting surfaces of adjacent blocks as will hereinafter be described.

Therefore, the criticallity of the dimensional precision of the cementitious building blocks of the present invention may be described as a height dimension of: the desired height in inches plus or minus 0.015 inches and a length dimension of the desired length in inches less an amount in the range of from 0.006 to 0.090 inches.

The block 10 is provided with an upper horizontally disposed surface 12, a parallel lower surface 14, vertically disposed and surfaces 16 and 18, and opposed vertical face surfaces 20 and 22. As will hereinafter be described in detail, the block 10 is provided with an identical pair of especially configured passages 24 and 26 separated by a partition 28, and which extends vertically through the block 10.

Figure 2:
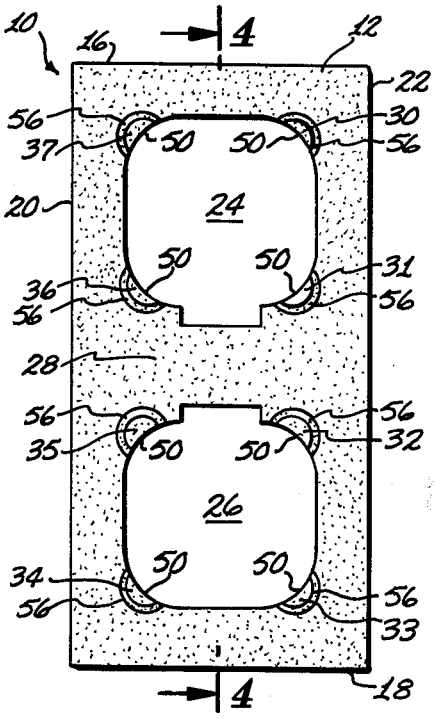
FIG. 2 is a top plan view of the cementitious building block of the present invention.

As seen best in FIG. 2, eight male projections are integrally formed on the upper horizontal surface 12, with those projections being designated by the numerals 30, 31, 32, 33, 34, 35, 36 and 37. Those projections 30–37 are each of one-half frustro-conical configuration, as will hereinafter be described in detail, and extend normally above the upper surface 12 of the block. The projections 30–33 are disposed in a row which extends longitudinally of the block 10, and are equally spaced with respect to each other. The projection 30 is spaced from the end 16 of the block 10 exactly the same distance as the projection 33 is spaced from its adjacent end surface 18 of the block 10. The projections 34–37 are equally spaced with respect to each other in another row which extends longitudinally of the block 10, with the space between the row of projections 30–33 and the row of projections 34–37 being exactly the same as the space between any two projections in the rows. Moreover, the rows of projections 30–33 are spaced from the vertical face 22 exactly the same distance as the row of projections 34–37 are spaced from the vertical face 20.

To avoid ambiguity and give definite meaning to the language describing the critical specific geometric arrangement of the projections 30–37, it will be seen that projections 30, 31, 36 and 37 are located at one end of the block 10, form a perfect square, and will hereinafter be identified as end projections. Likewise, the projections 32, 33, 34 and 35 are located at the opposite end of the block 10, form a perfect square, and will hereinafter be described as end projections. In addition to forming part of the end projections, the projections 31, 32, 35 and 36 form a perfect square and will be identified as intermediate projections. The square formed by end projections 30, 31, 36 and 37 is identically sized with respect to the square formed by end projections 32, 33, 34 and 35, and with respect to the square formed by intermediate projections 31, 32, 35 and 36.

As hereinbefore mentioned, the block 10 is provided with a pair of especially configured vertically extending passages 24 and 26 which are separated by a partition 28. The passage 24 is located between end projections 30, 31, 36 and 37, and the passage 26 is located between end projections, 32, 33, 34 and 35.

The passages 24 and 26 are of a specific cross sectional configuration, with that specific shape being critical. The criticallity of that shape provides the block 10 of the present invention with the characteristics and features that are mandatory and/or desirable in a block of the instant type. In the first place, the passages 24 and 26 must be of maximum cross sectional area to reduce the weight of the block as much as possible to facilitate shipping and handling thereof, and to effect a savings of cementitious material. However, the passages 24 and 26 must not be excessively large or else wall thickness would be reduced to a point that would effect the load bearing capabilities of the block. Further, the passages 24 and 26 must be sufficiently large to accommodate wiring and pipelines which may be located within walls constructed of a plurality of the blocks 10. For example, the passages 24 and 26 must be large enough to accept sewer pipes having a four inch outside diameter.

Figure 3:
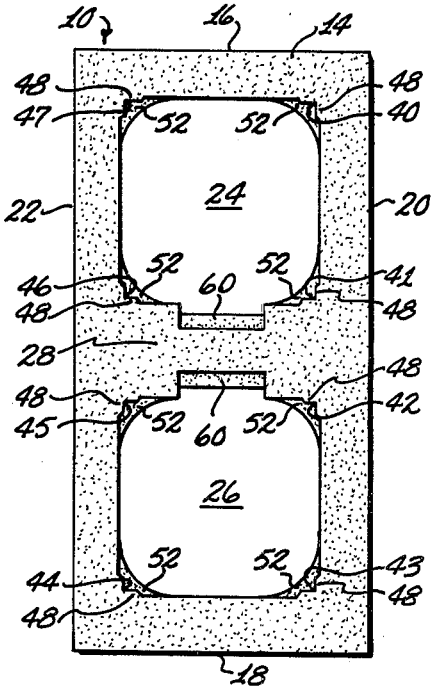
FIG. 3 is a bottom plan view of the cementitious building block of the present invention.

Therefore, the passages 24 and 26 are each formed with a substantially square horizontal cross sectional configuration with those passages opening onto the lower horizontal planar surface 14 to provide eight open corners which are identified by the reference numerals 40, 41, 42, 43, 44, 45, 46 and 47 in FIG. 3. The open corners 40–47 are disposed in the lower surface 14 in exactly the same geometric arrangement as the projections 30–37 are disposed on the upper surface 12. Thus, each projection is in vertical alignment with a different one of the open corners, with the projections and open corners forming the interlocking elements of the block 10, as will hereinafter be described in detail.

Figure 4:
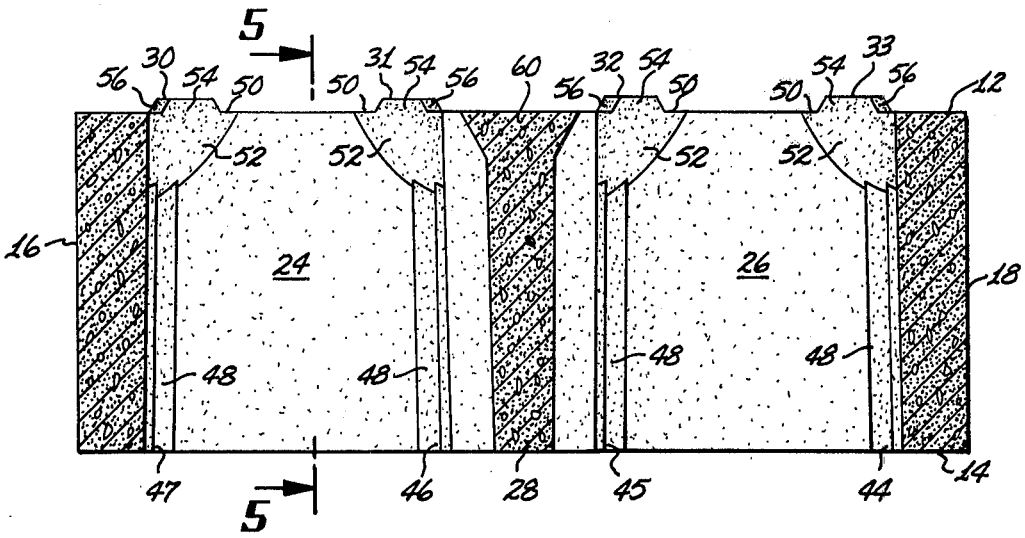
FIG. 4 is an enlarged sectional view taken on the line 4—4 of FIG. 2.
Figure 5:
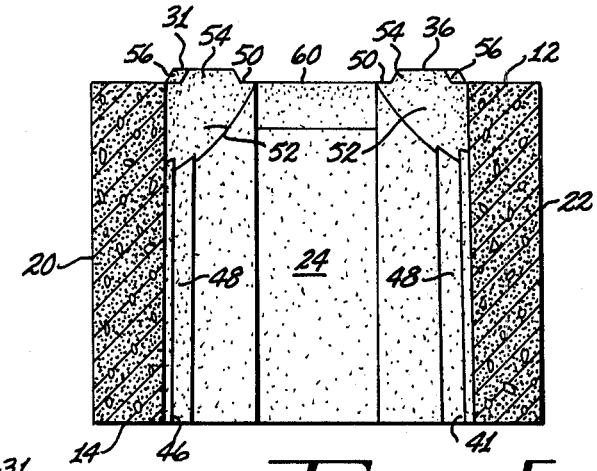
FIG. 5 is a sectional view taken on the line 5—5 of FIG. 4.

As is known in the art, formation of cementitious building blocks is accomplished by a molding process with the exterior configuration of the blocks being determined by a mold box and the interior configuration of the passages being determined by retractable cores. In order to facilitate removal of the cores from the blocks while the cement is green, i.e., prior to curing, the vertical passages are formed with a draft. Therefore, in the cementitious building block 10 of the present invention, as well as the other types of blocks to be hereinafter described, the vertical passages 24 and 26 are provided with a slight draft, which as seen in FIGS. 4 and 5 causes the passages to taper upwardly and inwardly from the bottom surface 14 to the top surface 12. Such drafts result in the passages 24 ad 26 being somewhat larger in horizontal cross section adjacent the bottom surface 14 than adjacent the top surface 12. Thus, to effect proper placement of the open corners 40–47, the preferred method for compensating for the drafts is to form the block with an inwardly facing L-shaped ledge 48 extending longitudinally in each corner of the passages 24 and 26.

It will be understood that an alternate way of compensating for the draft of the vertical passages 24 and 26 would be to size the passages somewhat smaller in horizontal cross section so that the open corners 40–47 are properly aligned with the projections 30–37 with the passages tapering upwardly and inwardly therefrom.

In any event, the above described identical geometric dispositions of the projections 30–37 and the open corners 40–47, it will be seen that a plurality of the blocks 10 can be assembled in any of the ways that conventional blocks are layed in formations of straight walls, corners, intersecting walls and the like. As seen best in FIGS. 2, 3, 4 and 5, the block 10 is provided with a corner spanning shelf 50 at each corner of the passages 24 ad 26 at the upper horizontal surface 12 of the block 10, with those shelves forming extensions of the planar surface 12 and being supported by corner corbels 52 which angularly depend from the shelves and merge with the interior walls which define the passages of the block 10.

Thus, the block 10 is provided with eight corbel supported corner shelves 50 which extend in cantilever fashion toward the center of the passages 24 and 26 and which support the upstanding projections 30–37 in the precise locations previously described. Each of the male projections 30–37 are preferrably of one-half frustroconical configuration, as hereinbefore mentioned, and are provided with a substantially planar vertical surface 54 which faces inwardly towards the center of its respective one of the passages 24 and 26. Therefore, each projection 30–37 of the block 10, is provided with an inwardly sloping arcuate surface 56 which faces outwardly from the center of its respective one of the passages with those surfaces designed and disposed to nestingly fit within the open corners 40–47 of a similar block when such a block is stacked thereon in a manner customary in the art.

As seen best in FIG. 4, the partition 28 which separates the passages 24 and 26 is preferrably formed with an upwardly and outwardly flared in cross section portion 60 at its upper end. The outwardly flared upper portion 60 is provided for two reasons; first, to facilitate lifting of the block 10 by a person assembling a plurality thereof and for esthetic reasons as will hereinafter be described.

As hereinbefore mentioned, one-quarter, one-half, and three-quarter blocks may be formed in accordance with the concepts of the present invention to facilitate the framing of wall openings, terminating walls, construction of block pillars and the like, and for aesthetic reasons.

Figure 6:
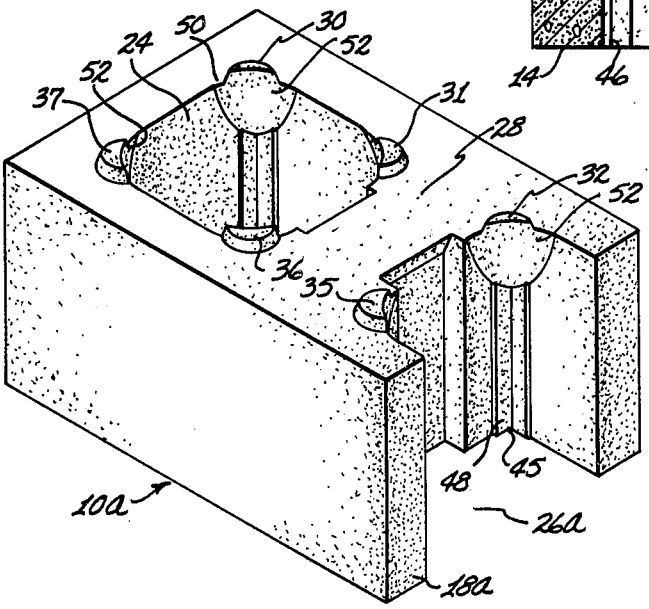
FIG. 6 is an isometric view of the three-quarter cementitious interlocking mortarless building block of the present invention.

Referring to FIG. 6 wherein a three-quarter cementitious block **10*a* is shown to be similar to the previously described full block 10, except that the three-quarter block 10*a* is formed to be three-fourths of the length of the full block 10 with all other dimensions and proportions being identical. This results in the passage 26*a* being one-half of the previously described passage 26, i.e., the passage 26*a* is of U-shaped horizontal cross section so as to be open on one laterally disposed end thereof which forms an interrupted end surface 18*a*. Therefore, the block 10*a* is open on one end which exposes the internal configuration of the passage 26*a*. It will be noted that the projections 32 and 35 are now end projections and are spaced from interrupted end surface 18*a* the same distance as projections 30 and 37 are spaced from end surface 16**.

Figure 7:
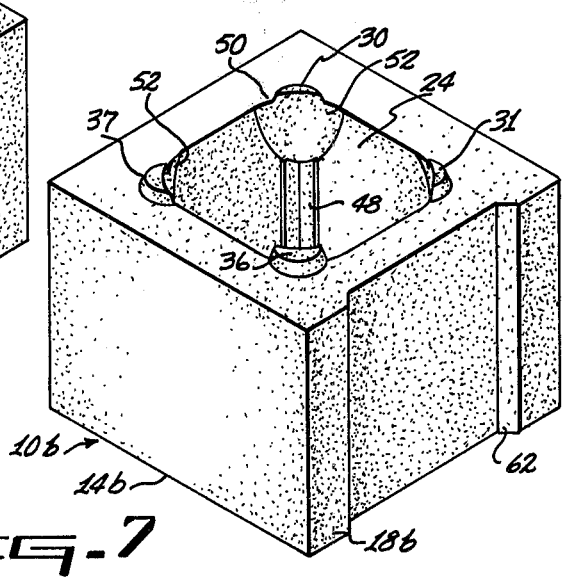
FIG. 7 is an isometric view of the one-half cementitious interlocking mortarless building block of the present invention.

FIG. 7 illustrates a half block **10*b* which is formed to be one-half of the length of the full block 10 with all other dimensions and proportions being the same. Thus, the half block includes only the passage 24, with its associated cementitious corner corbels 52 (three shown), each of which supports its integral corner shelf 50, four of the projections 30, 31, 36 and 37, and the four open corners (not shown) associated with the passage 24 at the lower planar surfaces 14*b*. It will be noted that projections 30, 31, 36 and 37 are spaced equidistantly from their respective adjacent end and side surfaces of the block 10*b*. In addition, the block 10*b* may be formed with an indentation 62 on the end 18*b*** for decorative purposes.

FIG. 8 illustrates a one-quarter block **10*c* which is formed to be one-fourth of the length of the full block 10 with all other dimensions and proportions being the same. Thus, the block 10*c* includes only those portions of the block which define one-half of the previously described passage 24. Therefore, the block 10*c* is similar to block 10*a* in that it is open on one end which exposes the internal configuration of the passage 24c which is U-shaped in horizontal cross section. The projections 30 and 37 are aligned with each other normally with respect to vertical face surfaces 20c and 22c and are equally spaced between end surface 16 and interrupted end surface 18c**.

FIG. 10 illustrates a typical way in which the blocks of the present invention are employed. As shown, a wall 66 is assembled by employing a plurality of the full blocks 10 in the customary manner in which such blocks are layed in laterally offset relationships. Termination of the wall 66 built in that manner results in an uneven end which is made into an even terminal end by alternately employing the three-quarter and one-quarter blocks 10a and 10c, respectively. It will be noted that the blocks 10a and 10c are positioned so that their open ends are exposed which takes advantage of the aesthetic effects produced by the geometric patterns displayed in those open ends. Many variations of aesthetic effects can be created in that by forming these blocks 10a and 10c without the male projections, these blocks can be alternately inverted if desired to arrive at various geometric arrangements. Further, the blocks 10a and 10c can be disposed in a manner so that their open ends are hidden which would result in a plain closed terminal end (not shown).

From the foregoing, it will be appreciated that the cementitious blocks 10, 10a, 10b and 10c can be interlockingly assembled in any desired manner without employing any mortar. However, if a more permanent structure is desired, a suitable adhesive (not shown), such as epoxy, can be applied to the mating surfaces of adjacent blocks. In any event, the blocks 10, 10a, 10b and 10c which are interlockingly assembled will produce a relatively smooth wall face, such as shown in FIG. 10. If desired, the cementitious blocks of the present invention can be formed to provide a simulated mortar gap (not shown), so that walls erected by employing the blocks of the present invention will display a more conventional appearance.

As shown in FIG. 9, a cementitious block 10d which is similar to block 10 is provided with an endless recessed channel 70 formed about the periphery of the vertical face 20d. A similar channel may be formed on the opposite vertical face (not shown) if desired. The channel 70 is preferrably sized so that when the blocks 10d are interlockingly assembled as previously described, the adjacent channels will simulate a conventionally sized mortar gap (not shown).

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An interlocking building block comprising:

(a) a cementitious body of rectangular configuration having an upper horizontal surface and a lower horizontal surface;

(b) a spaced pair of passages formed through said body so as to extend between the upper and lower surfaces thereof, said passages formed with square in horizontal cross sectional configurations and opening onto the lower surface of said body to provide eight open corners arranged in a predetermined array in the lower surface of said body;

(c) eight corner spanning shelves each located in a different corner of said pair of passages at the upper surface of said body, each of said shelves supported on an integral corner corbel so as to extend in cantilever fashion toward the center of its respective one of said passages; and (d) eight projections each integrally formed to extend upwardly from a different one of said shelves so as to be arranged on the upper surface of said body in the same geometric array as said open corners are arranged in the lower surface of said body.

2. An interlocking building block as claimed in claim 1 wherein:

said cementitious body is formed with a height of the desired dimension in inches $\pm 0.015$, and a length of the desired dimension in inches less an amount in the range of from 0.006 to 0.090.

3. An interlocking building block as claimed in claim 1 wherein the predetermined geometric array of the open corners provided by said passages comprises:

said open corners arranged in two spaced apart longitudinally extending rows with each row having four (4) of said open corners equidistantly spacedly arranged therein, the four (4) open corners in one row being transversely aligned with the four (4) open corners in the other row with the space between each adjacent pair of longitudinally aligned open corners being equal to the space between said pair of rows so that four open corners of the two (2) rows at one end of said body will define an end square, the four (4) open corners of the two rows that are spaced from the end projections of said body will define an intermediate square, and the four (4) open corners of the two (2) rows at the other end of said body will define another end square, all of said squares being equally sized.

4. An interlocking building block as claimed in claim 3 wherein each of said pair of spaced passages is located within a different one of the end squares defined by said open corners.

5. An interlocking building block as claimed in claim 1 wherein:

(a) said upper horizontal surface is defined by a spaced parallel pair of longitudinal side edges and a spaced pair of parallel transverse end edges;

(b) said projections are arranged in two spaced longitudinally extending rows with each row having four (4) of said projections equidistantly spacedly arranged therein, the four (4) projections in one row being transversely aligned with the four (4) projections in the other row with the space between each adjacent pair of longitudinally aligned projections being equal to the space between said pair of rows; and (c) each longitudinal row of projections being equally spaced inwardly from their respectively adjacent one of said side edges and the end projections of the rows being equally spaced inwardly from their respectively adjacent ones of said end edges.

6. An interlocking building block as claimed in claim 1 wherein each of said eight (8) projections are of equally sized one-half frustro-conical configuration.

7. An interlocking building block as claimed in claim 1 wherein each of said eight projections are equally sized with respect to each other, each of said projections configured to form one-half of a frustro-conical projection having a substantially planar vertical surface which is disposed to face toward the center of its respective one of said pair of passages.

8. An interlocking building block as claimed in claim 1 wherein the corner corbels which support said shelves depend angularly from their respective ones of said shelves and merge with the interior walls of said body which define said passages.

9. An interlocking building block comprising:

(a) a cementitious body of rectangular configuration having an upper horizontal surface and a lower horizontal surface;

(b) a first passage formed through said body so as to extend between the upper and lower surfaces thereof, said first passage formed with a square in horizontal cross sectional configuration and opening into the lower surface of said body to provide four open corners in the lower surface of said body;

(c) a second passage formed through said body so as to extend between the upper and lower surfaces thereof and having one open side to provide said body with an open end, said second passage substantially U-shaped in horizontal cross section and opening onto the lower surface of said body to provide an additional two open corners in the lower surface of said body;

(d) said four open corners provided by said first passage and said two additional open corners provided by said second passage being arranged in a predetermined array in the lower surface of said body;

(e) six corner spanning shelves each located in a different corner of said first and said second passages at the upper surface of said body, each of said shelves supported on an integral corner corbel and extending in cantilever fashion toward the center of its respective one of said first and said second passages; and (f) six projections each integrally formed to extend upwardly from a different one of said shelves so as to be arranged on the upper surface of said body in the same geometric array as said open corners are arranged in the lower surface of said body.

10. An interlocking building block as claimed in claim 9 wherein:

(a) said upper surface is defined by a spaced parallel pair of longitudinal side edges, a transverse end edge and an interrupted transverse end edge;

(b) said projections are arranged in two (2) spaced longitudinally extending rows with each row having three (3) of said projections equidistantly spacedly arranged therein, the three (3) projections in one row being transversely aligned with the three (3) projections in the other row with the space between each adjacent pair of longitudinally aligned projections being equal to the space between said pair of rows; and (c) each longitudinal row of projections being equally spaced inwardly from their respectively adjacent one of the side edges with two (2) transversely aligned end projections being spaced from the transverse end edge an amount equal to the space between the other two transversely aligned end projections and the interrupted transverse end edge.

11. An interlocking building block as claimed in claim 9 wherein each of said six projections are of equally sized one-half frustro-conical configuration.

12. An interlocking building block as claimed in claim 9 wherein each of said six projections are equally sized with respect to each other, each of said projections configured to form one-half of a frustro-conical projection having a substantially planar vertical surface which is disposed to face toward the center of its respective one of said first and said second passages.

13. An interlocking building block as claimed in claim 9 wherein the corner corbels which support said shelves depend angularly from their respective ones of said shelves and merge with the interior walls of said body which define said passages.

14. An interlocking building block comprising:

(a) a cementitious body having an upper horizontal surface, a lower horizontal surface, a pair of opposed vertical face surfaces, and an opposed pair of vertical end surfaces;

(b) a passage formed through said body so as to extend between the upper and lower surfaces and having one open side extending to one of the vertical end surfaces of said body, said passage substantially U-shaped in horizontal cross section and opening onto the lower surface of said body to provide a spaced pair of open corners in the lower surface of said body with those open corners arranged in a predetermined array in the lower surface of said body;

(c) a pair of corner spanning shelves each located in a different corner of said passage at the upper surface of said body, each of said shelves supported on an integral corner corbel and extending in a cantilever fashion toward the center of said passage; and (d) a pair of projections each integrally formed to extend upwardly from a different one of said shelves so as to be arranged on the upper surface of said body in the same geometric array as said open corners are arranged in the lower surface of said body.

15. An interlocking building block as claimed in claim 14 wherein:

(a) said upper horizontal surface of said body is defined by a spaced pair of opposed side edges, an end edge and an opposed interrupted end edge; and (b) said projections spacedly aligned with each other normally with respect to said opposed pair of side edges and equally spaced from said end edge and said interrupted end edge, each of said projections equally spaced from their respective adjacent ones of said opposed side edges.

16. An interlocking building block as claimed in claim 14 wherein each of said pair of projections are of equally sized one-half frustro-conical configuration.

17. An interlocking building block as claimed in claim 14 wherein each of said pair of projections are equally sized with respect to each other, each of said projections configured to form one-half of a frustro-conical projection having a substantially planar vertical surface which is disposed to face toward the center of said passage.

18. An interlocking building block as claimed in claim 14 wherein the corner corbels which support said shelves depend angularly from their respective ones of said shelves and merge with the interior walls of said body which define said passage.

19. An interlocking building block comprising:

(a) a cementitious body having an upper horizontal surface, a lower horizontal surface, an opposed pair of vertical face surfaces and an opposed pair of vertical end surfaces;

(b) a passage formed through said body so as to extend between the upper and lower surfaces thereof, said passage formed with a square in horizontal cross sectional configuration and opening onto the lower surface of said body to provide four open corners in the lower surface of said body with those open corners arranged in a predetermined array in the lower surface of said body;

(c) four corner spanning shelves each located in a different corner of said passage at the upper surface of said body, each of said shelves supported on an integral corner corbel and extending in cantilever fashion toward the center of said passage; and (d) four projections each integrally formed to extend upwardly from a different one of said shelves so as to be arranged on the upper surface of said body in the same geometric array as said open corners are arranged in the lower surface of said body.

20. An interlocking building block as claimed in claim 19 wherein:

said projections define and locate the four corners of a square which is centrally located on the upper surface of said body.

21. An interlocking building block as claimed in claim 19 wherein each of said pair of projections are of equally sized one-half frustro-conical configuration.

22. An interlocking building block as claimed in claim 19 wherein each of said projections are equally sized with respect to each other, each of said projections configured to form one-half of a frustro-conical projection having a substantially planar vertical surface which is disposed to face toward the center of said passage.

23. An interlocking building block as claimed in claim 19 wherein the corner corbels which support said shelves depend angularly from their respective ones of said shelves and merge with the interior walls of said body which define said passage.

* * * * *